US012291942B2

(12) United States Patent
Rusten et al.

(10) Patent No.: US 12,291,942 B2
(45) Date of Patent: May 6, 2025

(54) SYSTEM AND METHOD FOR FORMING A PERMANENT BARRIER IN A WELL

(71) Applicant: Interwell P&A AS, Hafrsfjord (NO)

(72) Inventors: Torgeir Rusten, Vikhammer (NO); Stian Tøndel, Trondheim (NO)

(73) Assignee: INTERWELL P&A AS, Hafrsfjord (NO)

( * ) Notice: Subject to any disclaimer, the term of this patent is extended or adjusted under 35 U.S.C. 154(b) by 0 days.

(21) Appl. No.: 18/275,923

(22) PCT Filed: Mar. 10, 2022

(86) PCT No.: PCT/EP2022/056115

§ 371 (c)(1),
(2) Date: Aug. 4, 2023

(87) PCT Pub. No.: WO2022/194654

PCT Pub. Date: Sep. 22, 2022

(65) Prior Publication Data

US 2024/0117711 A1 Apr. 11, 2024

(30) Foreign Application Priority Data

Mar. 19, 2021 (NO) ..... 20210355

(51) Int. Cl.
*E21B 33/12* (2006.01)
*E21B 36/00* (2006.01)

(52) U.S. Cl.
CPC ..... *E21B 36/008* (2013.01); *E21B 33/1204* (2013.01)

(58) Field of Classification Search
None
See application file for complete search history.

(56) References Cited

U.S. PATENT DOCUMENTS

2015/0034317 A1 2/2015 Skjold
2015/0211322 A1 7/2015 Lowry et al.
2015/0211326 A1 7/2015 Lowry et al.
2017/0306714 A1 10/2017 Haugland
(Continued)

FOREIGN PATENT DOCUMENTS

WO 2020/144091 7/2020

OTHER PUBLICATIONS

International Search Report issued May 31, 2022 in corresponding International (PCT) Patent Application No. PCT/EP2022/056115.
(Continued)

*Primary Examiner* — Tara Schimpf
*Assistant Examiner* — Ursula Lee Norris
(74) *Attorney, Agent, or Firm* — Wenderoth, Lind & Ponack, L.L.P.

(57) ABSTRACT

The present invention relates to a well tool system for forming a permanent barrier in a well, the system comprising: a well tool device comprising a pyrotechnic mixture and an ignition device provided within or adjacent to the pyrotechnic mixture; a tool string connected above the well tool device; and a replenishment string connected between the well tool device and tool string. The replenishment string comprises pyrotechnic mixture. The elevating device is configured to control the movement of the replenishment string towards a heat generating process started by means of the ignition device.

13 Claims, 7 Drawing Sheets

(56) References Cited

U.S. PATENT DOCUMENTS

| | | | | |
|---|---|---|---|---|
| 2020/0362662 | A1* | 11/2020 | Zhang | C09K 8/46 |
| 2022/0145726 | A1* | 5/2022 | Head | E21B 33/134 |
| 2023/0340857 | A1* | 10/2023 | Head | E21B 33/1208 |

OTHER PUBLICATIONS

Written Opinion issued May 31, 2022 in corresponding International (PCT) Patent Application No. PCT/EP2022/056115.
Search Report issued Oct. 14, 2021 in corresponding Norwegian Patent Application No. 20210355.

* cited by examiner

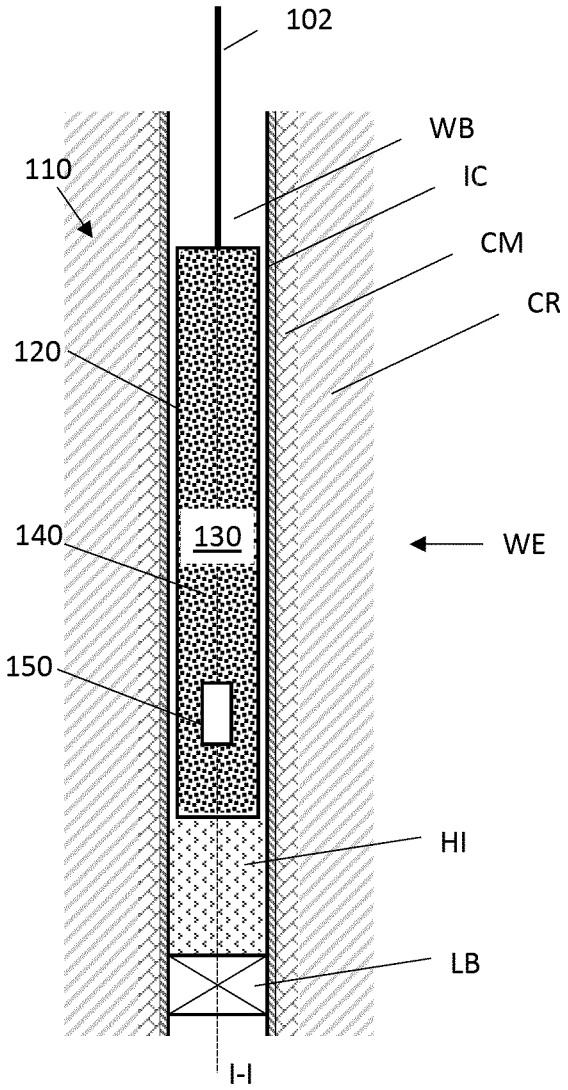
Fig. 1a: Prior art
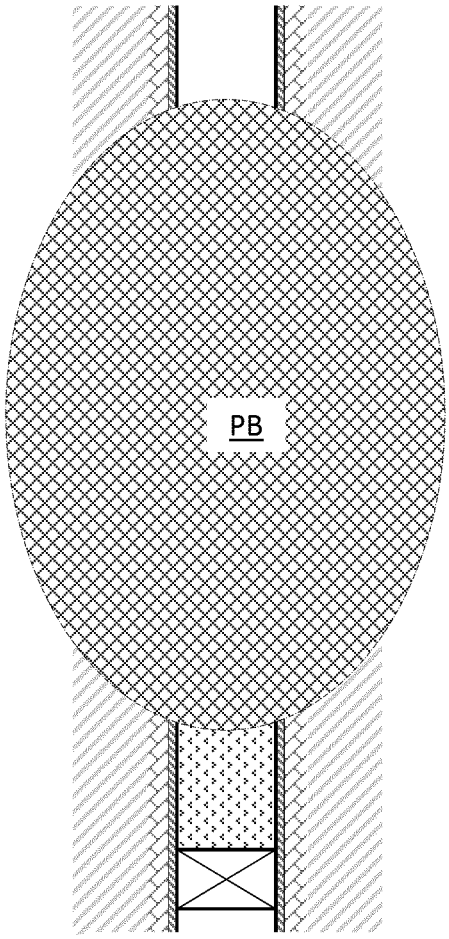
Fig. 1b: Prior art

SYSTEM AND METHOD FOR FORMING A PERMANENT BARRIER IN A WELL

FIELD OF THE INVENTION

The present invention relates to a well tool system for forming a permanent barrier in a well. The present invention also relates to a method for forming a permanent barrier in a well.

BACKGROUND OF THE INVENTION

Plugging and abandonment operations, often referred to as P&A operations, are performed to permanently close oil and/or gas wells. Typically, this is performed by providing a permanent well barrier above the oil and/or gas producing rock types, typically in the cap rock in which the well has been drilled through.

There are several technical and regulatory requirements for such permanent well barriers, some of which are a) impermeability of oil and/or gas through the permanent well barrier, b) long term integrity, c) non shrinking of the permanent well barrier, d) ductility (non brittle)—the permanent well barrier must be able to withstand mechanical loads or impact, e) resistance to different chemicals/substances (H2S, C02 and hydrocarbons) and f) wetting—to ensure bonding to steel.

In WO2013/135583 (Interwell P&A AS), it is disclosed a method for performing a P&A operation wherein a first step, it was provided an amount of a heat generating mixture (for example thermite) at a desired location in the well and thereafter to ignite the heat generating mixture to start a heat generation process. It is also disclosed a tool for transporting the heat generating mixture into the well before ignition. Such a heat generating mixture may also be referred to as a pyrotechnic mixture.

In short, the above prior art will be described with reference to FIGS. 1*a* and 1*b*. In FIG. 1, a well WE is shown to be provided through a section of a cap rock CR. The inner surface of a well bore WB is provided by an inner casing IC, where cement CM is provided in the annulus between the inner casing IC and the cap rock CR. It should be noted that some wells have several casings provided radially outside of each other, where cement or fluids are provided in the respective annuli. In FIG. 1*a*, it is shown that a lower barrier LB has been provided in the well bore WB. Above the lower barrier LB a heat insulating material HI, such as sand, has been provided. A well tool 110 has been lowered into the well above the heat insulating material HI by means of a wireline 102. The well tool 110 comprises a housing 120 with a compartment 130 which contains a heat generating mixture 140 (for example thermite). An ignition device 150 is also provided in the compartment 130. The ignition device 150 starts the heat generating process of the heat generating mixture 140. The ignition device 150 may be time actuated or pressure actuated. Alternatively, the ignition device 150 may be actuated by means of a topside signal transferred via wire to the ignition device.

The result after the ignition is shown in FIG. 1*b*. Here it is shown that the elements of the well, i.e. inner casing IC, cement CE and cap rock CR have melted and thereafter hardened into one solid permanent well barrier PB containing constituents of rock, cement, steel and other elements being present in the well. Such other elements are the end product of the heat generation process, remains of the tool used to transport the heat generating mixture into the well, the ignition system etc.

This technology has been tested in test centers and in field trials, in order to verify that the permanent well barrier fulfills technical and regulatory requirements.

One object of the present invention is to provide a more efficient method for providing a permanent barrier in a well.

SUMMARY OF THE INVENTION

The present invention relates to a well tool system for forming a permanent barrier in a well, the system comprising:

- a well tool device comprising a pyrotechnic mixture and an ignition device provided within or adjacent to the pyrotechnic mixture, wherein the pyrotechnic mixture comprises a first constituent in the form of a metal oxide and a second constituent in the form of a metal;
- a tool string connected above the well tool device;
- an elevating device connected to the well tool device via the tool string;
- a replenishment string connected between the well tool device and the tool string;

wherein the replenishment string comprises the first constituent and/or the second constituent;

wherein the elevating device, after a heat generating process is started by means of the ignition device, is configured to control the movement of the replenishment string towards the heat generating process.

In many operations, the replenishment string will be pulled downwardly towards the heat generating process by means of gravity. Here, the elevating device is controlled to brake or to slow down the movement of the replenishment string. However, in some operations, gravity will not move the replenishment string sufficiently fast towards the heat generating process. Here, the elevating device is controlled to push the replenishment string towards the heat generating process.

In one aspect, the permanent barrier is a cap-rock to cap-rock permanent barrier extending across the whole cross-section of a wellbore.

The pyrotechnic mixture will, when ignited by the ignition device, start a heat generating exothermic reduction-oxidation process. The heat generating process is configured to melt the surroundings of the well at the location of the well tool device in the well.

In one aspect, the replenishment string is a longitudinal extension of the tool string.

In one aspect, the replenishment string has several properties in common with the tool string. They may have equal outer diameter. They may comprise several string sections having equal length. The string sections may have the same type of end connection interfaces for connection to other string sections.

In one aspect, the replenishment string comprises an elongated housing and a compartment within the elongated housing, wherein the compartment contains the first constituent and/or the second constituent.

In one aspect, a cross sectional area of the compartment may be equal to a cross sectional area of a compartment of the tool string. In one aspect, a material of the elongated housing may be equal to the material of the material of the housing of the tool string.

In one aspect, the well tool system comprises a setting tool provided between the replenishment string and the well tool device, wherein the setting tool is configured to disconnect the replenishment string from the well tool device.

In one aspect, the well tool device comprises an anchoring device for anchoring of the well tool device to the well.

In one aspect, the anchoring device is set by gravity, i.e. the weight above the anchoring device will cause the anchoring device to radially expand into contact with the well.

In one aspect, the setting tool is configured to radially expand the anchoring device of the well tool device before disconnecting the replenishment string from the well tool device.

In one aspect, the replenishment housing is made of the first constituent and/or the second constituent.

In one aspect, the first constituent comprises bismuth oxide and the second constituent comprises aluminum.

In one aspect, the elevating device is located topside.

In one aspect, the tool string is a drill pipe type of string, a coiled tubing type of string, or a wireline type of string.

In one aspect, the elevating device is a top drive or rotary table when the tool string is a drill pipe type of string, a reel drive or injector when the tool string is a coiled tubing type of string or a reel drive when the tool string is a wireline type of string.

In one aspect, the replenishment string comprises one or a plurality of sensors for sensing the heat distribution along the replenishment string; and wherein the elevating device, is configured to control the movement of the replenishment string towards the heat generating process based on signals from the one or the plurality of sensors.

In one aspect, the sensor is an optic fiber sensor guided in the longitudinal direction of the replenishment string.

In one aspect, the replenishment string comprises one or more further ignition devices provided within or adjacent to the pyrotechnic mixture.

The one or more further ignition devices may restart the heat generating process again, should the heat generating process stop for some reason.

In one aspect, the replenishment string further comprises an electric wire connected to the one or more further ignition devices for igniting the ignition devices.

In one aspect, the pyrotechnic mixture provided in a lower end of the replenishment string has a first set of properties; wherein the pyrotechnic mixture provided in an upper end of the replenishment string has a second set of properties being different from the first set of properties; and wherein the elevating device, is configured to control the movement of the replenishment string towards the heat generating process based on the first set and the second set of properties.

In one aspect, the first and second set of properties being different may be the particle size of the first and/or second constituents, additives used in the pyrotechnic mixture, etc.

DETAILED DESCRIPTION

Embodiments of the present invention will be described in detail below with reference to the enclosed drawings, wherein:

FIGS. 1*a* and 1*b* illustrates a prior art well tool for performing a P&A operation;

FIG. 2*a* shows an first embodiment of a well tool system with a tool string and a replenishment string in the form of a drill pipe string;

FIG. 2*b* illustrates an enlarged view of one section of the replenishment string;

FIG. 2*c* illustrates that a well tool device has been set in the well above a plug and where the replenishment string has been disconnected from a well tool device;

FIG. 3*a* illustrates a well tool system with a tool string and a replenishment string in the form of a coiled tubing string;

FIG. 3*b-d* illustrates cross sections of different embodiments of the replenishment string of FIG. 3*a;*

FIG. 4*a* illustrates a well tool system with a tool string and a replenishment string in the form of a wireline string;

FIG. 4*b*-4*c* illustrate cross sections of different embodiments of the replenishment string of FIG. 4*a;*

FIRST EMBODIMENT

Figure 2A:
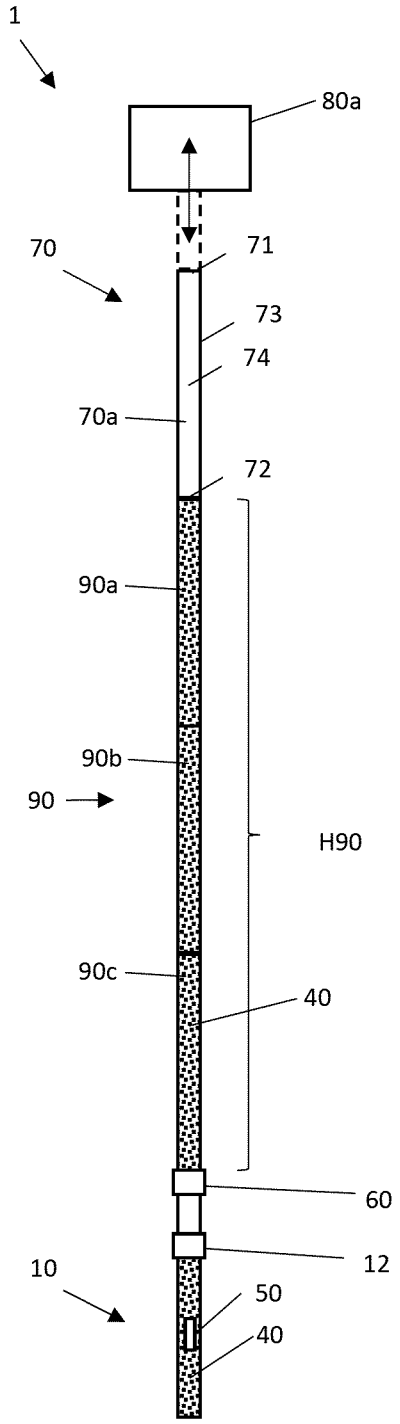

It is now referred to FIG. 2*a*, where it is shown a well tool system 1 for forming a permanent barrier in a well WE.

In the lower end, the system comprises a well tool device 10 comprising a pyrotechnic mixture 40 and an ignition device 50 provided within or adjacent to the pyrotechnic mixture 40, wherein the pyrotechnic mixture 40 comprises a first constituent 45 in the form of a metal oxide and a second constituent 46 in the form of a metal. This well tool device 10 may be the prior art well tool device 110.

In the present embodiment, there are some differences with respect to the prior art well tool device 110. A first difference is that the well tool device comprises an anchor 12 for securing the well tool device 10 relative to the inner surface of the well. The anchor 12 may prevent upwardly directed movement of the well tool device 10 (for example caused by the heat generating mixture forcing the upper part of the well tool device 10 upwardly), it may prevent downwardly directed movement (for example caused by gravity) or both.

A second difference is that in the present embodiment, the metal oxide is bismuth oxide, also referred to as bismuth(III) oxide or Bi2O3 and the metal is aluminum Al or an aluminum alloy.

The pyrotechnic mixture 40 will, when ignited by the ignition device 50, start a heat generating exothermic reduction-oxidation process:

$$Bi_2O_3+2Al \rightarrow Al_2O_3+2Bi+heat$$

This type of pyrotechnic mixture 40 is often referred to as thermite, and the heat generating reaction is often referred to as a thermite reaction.

The heat will melt the surroundings at the location of the well tool device, such as casing, cement, and possibly also parts of the formation radially outside of the casing and cement. It should be noted that there may be two or more casings outside of each other. The annulus between the casings may be fluid-filled, filled with cement, gravel or other materials. After cooling, a cap-rock to cap-rock permanent barrier extending across the whole cross-section of a wellbore may be the result. Hence, the result may be similar to the result shown in FIG. 1*b*.

The system 1 further comprises a string connected to the upper end of the well tool device 10 by means of a setting tool 60. The upper end of the string is connected to an elevating device 80, which is used to move the string and the well tool device 10 up and down to its desired location in the well.

The system 1 comprises different substrings. First, the system 1 comprises an upper tool string indicated in FIG. 2*a* as reference number 70. Second, the system 1 comprises a replenishment string 90 connected between the setting tool 60 and the tool string 70.

In FIG. 2*a*, the tool string 70 and the replenishment string 90 are a drill pipe type of string, comprising several string sections 70*a*, 90*a*, 90*b*, 90*c* connected to each other by means of connection interfaces 71, 91 in their upper end being connectable to connection interfaces 72, 92 in their lower end. In FIG. 2*a*, a height H90 of the replenishment string 90 is indicated to comprise three drill pipe sections, each drill pipe section having a height of ca 27-45 feet (8-13 meter). It should be noted that the total height of the tool string 70 typically will be much longer than the height H90 of the replenishment string 90.

The drill pipe type of string is rigid, enabling it to be pushed actively into the well. The drill pipe type of string has a relatively high weight, and can therefore also be lowered relatively fast into the well by gravity. It is now referred to FIG. 2*b*. Here it is shown that the replenishment string 90 comprises an elongated housing 93 and a compartment 94 within the elongated housing 93, wherein the compartment 94 contains the first constituent 45 and/or the second constituent 46.

Figure 2B:
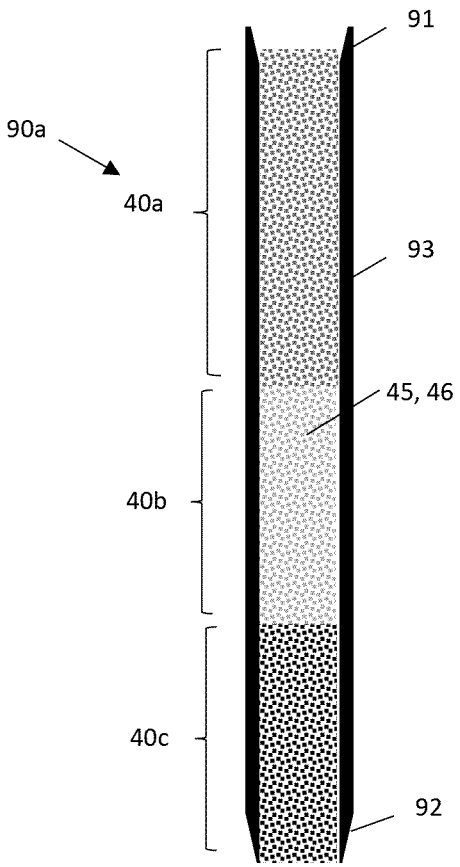

The entire replenishment string 90 may comprise the same type of pyrotechnic mixture 40. Alternatively, each section 90*a*, 90*b*, 90*c* may comprise different types of pyrotechnic mixtures 40. In yet an alternative, as indicated in FIG. 2*b*, one section of drill pipe may comprise layers 40*a*, 40*b*, 40*c* of different pyrotechnic mixtures 40.

The term "different type" may refer to other metal oxides and metals than the abovementioned bismuth oxide and aluminum. One alternative embodiment is iron oxide and aluminum, but there are various other metal oxides and metals.

The term "different type" may also refer to different particle size of the first and/or second constituents used in the respective layers of the pyrotechnic mixture 40, it may refer to different additives used in respective layers of pyrotechnic mixture 40, etc.

It should be noted that the pyrotechnic mixture 40 is provided stationary with respect to the housing 93. Hence, the pyrotechnic mixture 40 should not move up in the compartment 94 within the housing 93 due to the pressure difference between the well pressure and the pressure topside. In the same way, the pyrotechnic mixture 40 should not down and out from the compartment 94 within the housing 93 due to gravity. The pressure above the pyrotechnic mixture 40 may be balanced with the well pressure as the replenishment string 90 is lowered into the well, to reduce a differential pressure between the inside and the outside of the housing 93.

The pyrotechnic mixture 40 may be held stationary with respect to the housing 93 by means of binding agents. The pyrotechnic mixture 40 may be provided as solid blocks or discs, where the inner surface of the housing 93 comprises restrictions which are holding these blocks or discs stationary. These restrictions may not be a part of the housing itself, but may be provided by means of a sleeve inserted into the housing.

SECOND EMBODIMENT

Figure 3A:
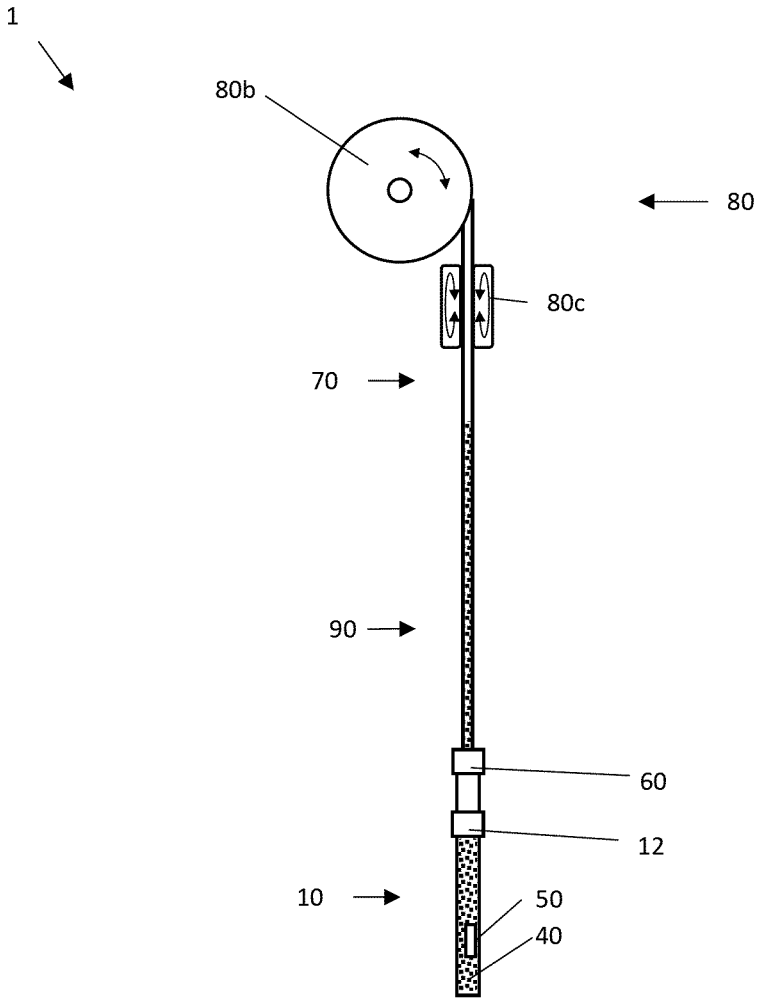

It is now referred to FIG. 3*a*. Here, the tool string 70 and the replenishment string 90 are a coiled tubing type of string. The coiled tubing type of string is also rigid, enabling it to be pushed actively into the well. Even though being lighter than the string of the first embodiment, also the coiled tubing can be lowered into the well by gravity.

Similar to the drill pipe in the first embodiment, also here the replenishment string 90 is a longitudinal extension of the tool string 70, and the cross sectional area of the compartment 94 may be equal to a cross sectional area of a compartment of the tool string 70.

As is known, coiled tubing are typically stored as one continuous string reeled up on a drum, where the movement of the coiled tubing up and down in the well is performed by a reel drive rotating the drum and/or by an injector 80*b* pushing or pulling the coiled tubing into or out from the well.

In FIG. 3*a*, it is shown that the replenishment string 90 comprises a housing 93 and a compartment 94 within the housing 93 filled with pyrotechnic mixture 40. Here, the housing 93 is a pipe. It should be noted that also here, there may be layers of different pyrotechnic mixtures 40, as described in the first embodiment above.

Figures 3B, 3C, 3D:
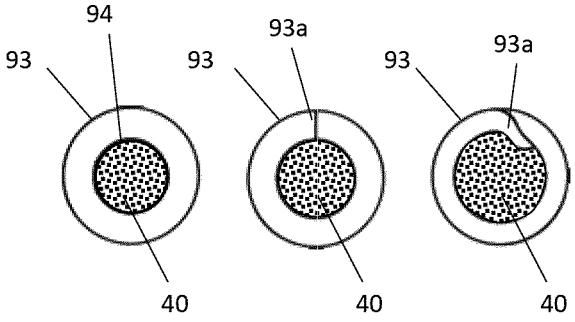

In FIG. 3*b*, the housing 93 is made by rolling the material of the housing and joining the end surfaces of the material, as indicated by the joint 93*a*.

The embodiment in FIG. 3*d* corresponds to the embodiment in FIG. 3*c*. Here, the joint 93*a* is formed by overlapping end surfaces of the material.

One difference between coiled tubing and drill pipe is that the drill pipe typically can be lowered one length of drill pipe section before a pause is required to join a further drill pipe section on top of the previous drill pipe section. The typical length of such a drill pipe section is 12 m. Coiled tubing can be lowered continuously into the well without any such pause.

THIRD EMBODIMENT

Figure 5:
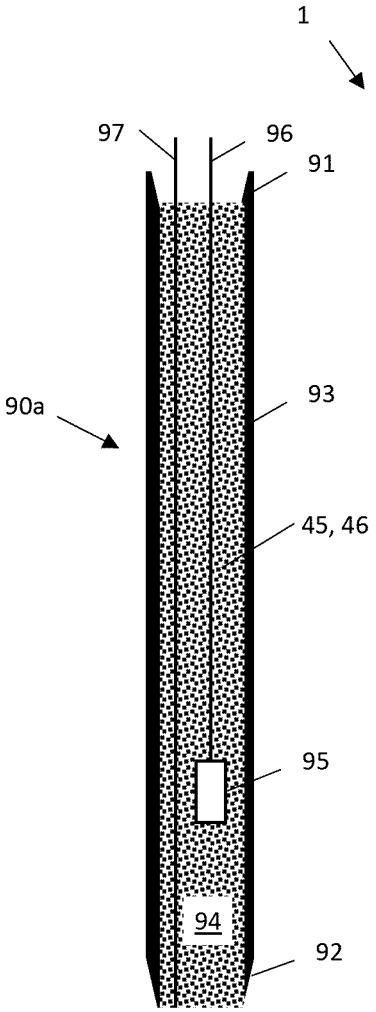
FIG. 5 illustrates an alternative embodiment of the replenishment string section of FIG. 2*b;*

It is now referred to FIG. 5. Here, the tool string 70 is a wireline type of tool string. As a wireline is flexible, it cannot be pushed actively into the well. As is known a wireline does not comprise a central bore or compartment in which the pyrotechnic mixture 40 may be located.

Figure 4A:
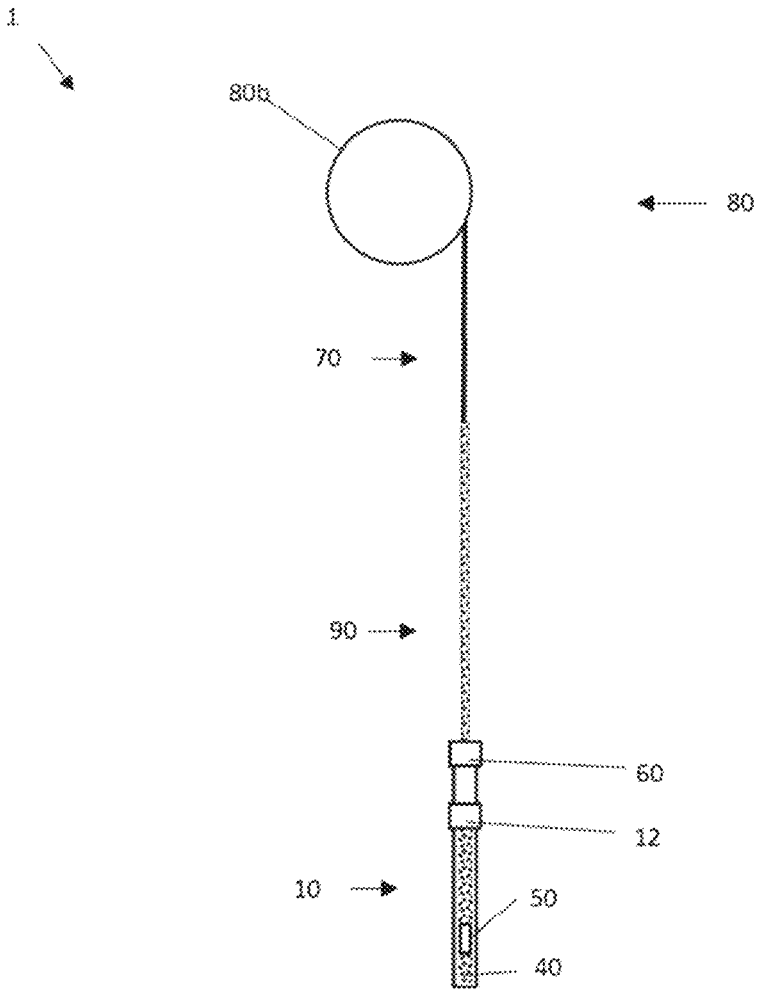
Figures 4B, 4C:
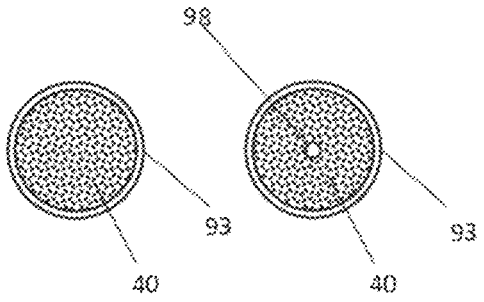

As a first example (shown in FIG. 4*b*), the replenishment string 90 comprises a flexible housing 93 in the form of a hose (for example similar to a fire hose, a garden hose etc. with a suitable outer diameter), filled with pyrotechnic mixture 40. Hence, also the replenishment string 90 will be relatively flexible. Here, the lower end of the wireline 70 is connected to the upper end of the hose 90.

As a second example (shown in FIG. 4*c*), the wireline 70 is continued inside the flexible housing 93 as a replenishment wireline 98, to ensure that weight of the well tool device 10 and the setting tool 60 can be carried by the replenishment string 90.

As a third example, the replenishment string 90 comprises a more rigid housing 93, for example a section of coiled tubing etc. filled with pyrotechnic mixture 40. Here, the cross section of the replenishment string 90 will be similar to one of FIGS. 3*b*, 3*c*, 3*d*.

As is known, wireline is typically stored reeled up on a drum, where the movement of the wireline up and down in the well is performed by a reel drive rotating the drum. In all of the above examples, gravity must be used when lowering the replenishment 90 towards the heat generating process.

FOURTH EMBODIMENT

It is now referred to FIG. 5. Even though the replenishment string 90 here is of the drill pipe type, the features of the fourth embodiment can be used with the other types of replenishment strings as well.

In FIG. 5 it is shown that the replenishment string 90 comprises a fiber optic sensor 97, which may be of the type fibre Bragg gratingLight reflected from the fiber optic sensor 97 changes dependent on temperature and/or the length of the fiber. This information can be used by the elevating device 80 to control the speed of the movement of the replenishment string 90 towards the heat generating process based on signals from the one or the plurality of sensors 97.

Of course, other types of sensors may be used for this purpose, for example a number of spaced apart temperature sensors will also give information about the temperature at different positions in the replenishment string 90.

In FIG. 5 it is further shown that the replenishment string 90 comprises an ignition device 95 and an electric wire 96 connected to the ignition device 95. The ignition device 95 may restart the heat generating process again, should the heat generating process stop for some reason. The conditions for restating the heat generating process may be detected by the fiber optic sensor 97.

FIFTH EMBODIMENT

Figure 6:
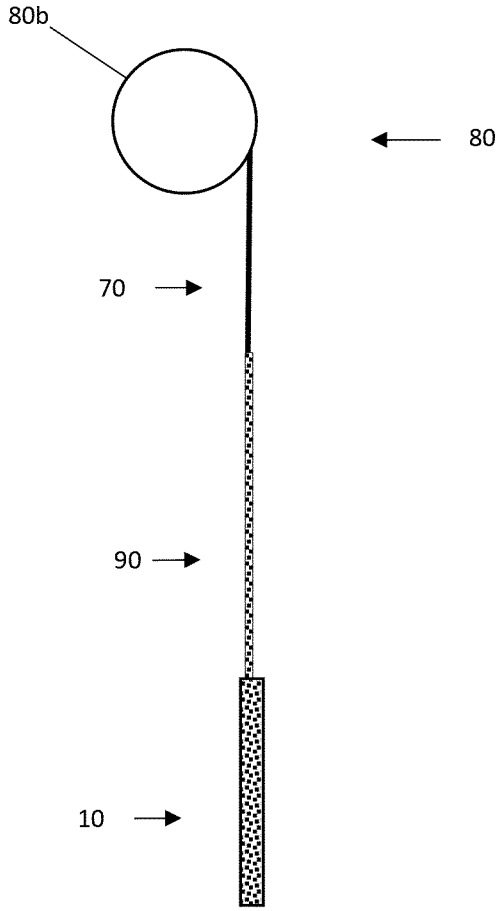
FIG. 6 illustrates an alternative embodiment of the well tool system of FIG. 4*a;*

It is now referred to FIG. 6. Here it is shown an embodiment of the system 1 without a setting tool 60. Hence, here the well tool device 10 is secured below the replenishment string 90, and there is no release of the replenishment string 90 from the well tool device 10 before ignition of the ignition device 50 of the well tool device 10. However, as the material of the housing of the well tool device 10 or the housing of the replenishment string 90 will melt by the heat of the heat generation process or be consumed as part of the heat generation process, it will still be possible to move the replenishment string up and down relative to the location of the heat generation process.

Again, even though FIG. 6 shows the wireline type of tool string 70, the fifth embodiment may be used for the other types of string as well.

SIXTH EMBODIMENT

Figure 7:
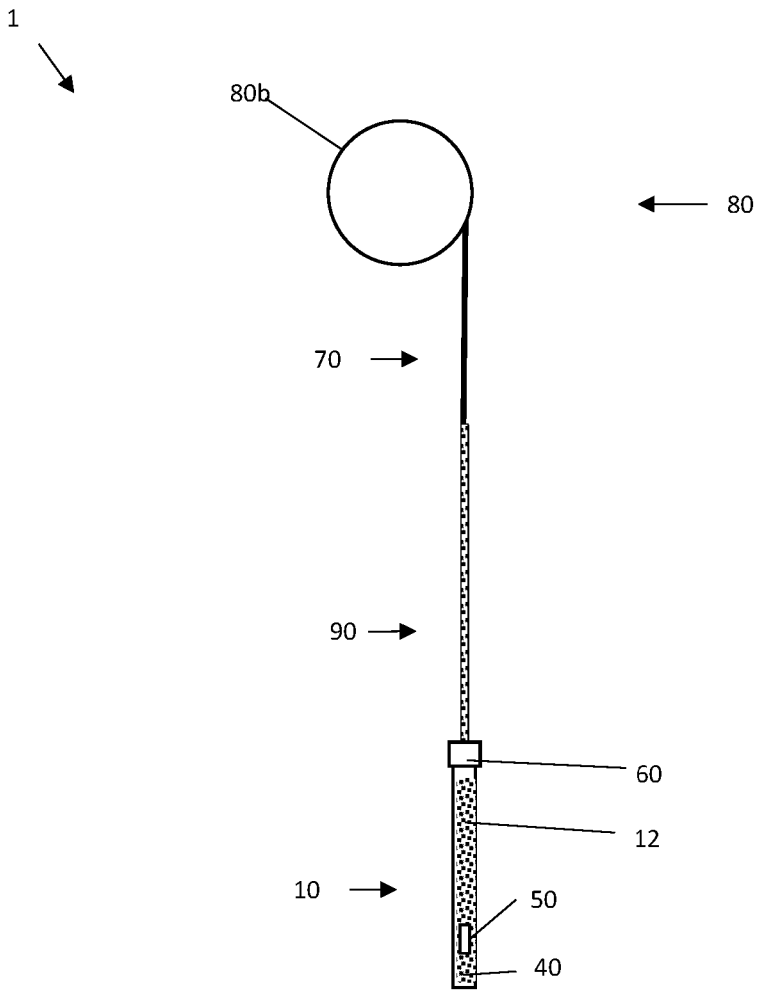
FIG. 7 illustrates yet an alternative embodiment of the well tool system of FIG. 4*a.*

It is now referred to FIG. 7. Here it is shown an embodiment of the system 1 without an anchoring device 12. Here, the well tool device 10 is lowered until it is supported by the lower barrier LB and/or heat insulation material HI and then the well tool device 10 is released from the replenishment string 90 by means of the setting tool 60 before ignition of the ignition device 50 of the well tool device 10. Hence, the setting tool 60 is only a releasing tool. After ignition, the replenishment string 90 is moved relative to the location of the heat generation process.

Again, even though FIG. 7 shows the wireline type of tool string 70, the sixth embodiment may be used for the other types of string as well.

Operation of the Well Tool Device

The operation of the first embodiment will now be described. It should be noted that the same or similar operation may be performed for the other embodiments as well.

Figure 2C:
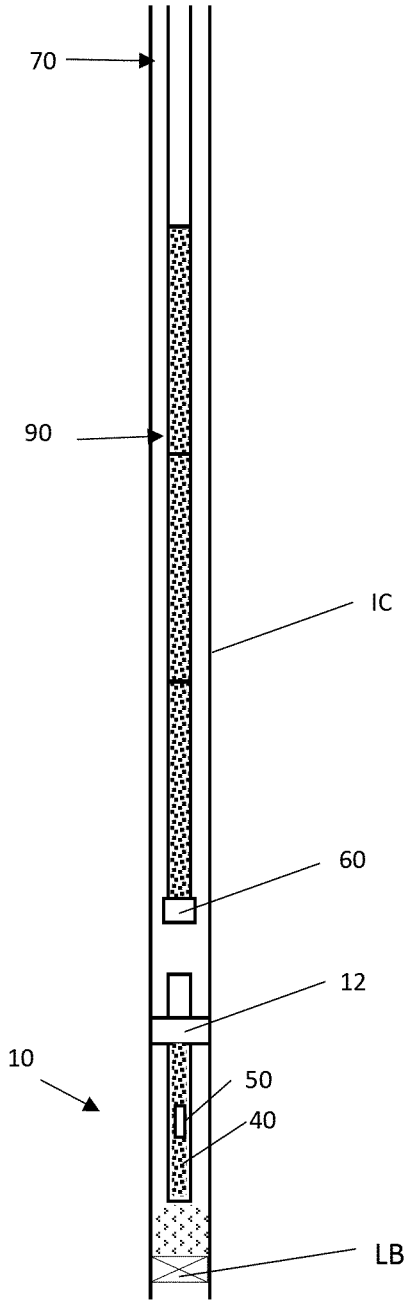

It is now referred to FIG. 2*c*. Here it is shown that the well tool device 10 has been set above a lower barrier LB, similar to the situation in FIG. 1*a*. The anchoring device 12 has been radially expanded by means of the setting tool 60 and the tool string 70 and the replenishment string 90 has been lifted up a distance from the well tool device 10. In some of the above embodiments, there is no setting tool 60 and hence no movement of the replenishment string 90 relative to the well tool device 10 before ignition. In some of the above embodiments, there is no anchoring device 12, but the setting tool 60 releases the replenishment string 90 from the well tool device before ignition, allowing movement of the replenishment string 90 relative to the well tool device 10 before ignition.

The ignition device 50 of the well tool device 10 is now starting the heat generating process. The ignition device 50 may ignite based on an ignition signal sent via a wire (not shown in FIG. 2*c*), an ignition signal sent wirelessly or an ignition signal sent from circuitry (a timer etc. not shown in FIG. 2*b*) in the well tool device.

After the heat generating process has started, the elevating device 80 is controlling the movement of the replenishment string 90 down towards the heat generating process, and further amounts of the pyrotechnic mixture 40 is supplied to or replenished to the process.

It should be noted that in many cases, the replenishment string 90 will be pulled downwardly towards the heat generating process by means of gravity. Here, the elevating device 80 is braking the movement of the replenishment string 90.

However, in some operations, gravity will not move the replenishment string 90 sufficiently fast towards the heat generating process. Here, the elevating device 80 is controlled to push the replenishment string 90 towards the heat generating process.

According to the above, it is achieved that the reaction process can be tailored to different operational requirements. For example, the temperature can be increased in specific areas of the well cross section by rapid feeding and/or by adjusting the pyrotechnic mixture in some sections of the replenishment string.

Alternatively, the temperature may be decreased by slowing down the feeding to reduce impact on well elements and host rock/geological formation.

One layer of pyrotechnic mixture may delay the continuation of the reaction to allow reaction materials to separate and increase bonding to the host rock before continuing the feed.

In addition, the feeding can be controlled in such a way that the total barrier length can be increased and that the barrier is in accordance with technical requirements and regulations at the desired location (i.e. the location of the well tool device and immediately above the location of the well tool device).

It should be noted at the pressure within the drill pipe string, i.e. the pressure inside the tool string 70 and the replenishment string 90 may be controlled from topside.

Moreover, the elevating device 80 may be configured to control the movement of the replenishment string 90 towards the heat generating process based on these first set and the second set of properties.

ALTERNATIVE EMBODIMENTS

In an alternative embodiment, the well tool device 10 may be lowered in a separate operation from the replenishment string 90. Hence, the replenishment string 90 does not need to carry the load of the well tool device 10. Here, it is possible to use the metal of the pyrotechnic mixture 40 as a material of the housing 93 of the replenishment string 90. Hence, the compartment 94 will contain a larger amount of metal oxide or the compartment 94 will contain only metal oxide.

It should further be noted that the replenishment string 90 and the tool string 70 may comprise one or more electric wires for control signals to the ignition device 50 of the well tool device.

The invention claimed is:

1. A well tool system for forming a permanent barrier in a well, the system comprising:

a well tool device comprising a pyrotechnic mixture and an ignition device provided within or adjacent to the pyrotechnic mixture, wherein the pyrotechnic mixture comprises a first constituent in the form of a metal oxide and a second constituent in the form of a metal;

a tool string connected above the well tool device;

an elevating device connected to the well tool device via the tool string; and a replenishment string connected between the well tool device and the tool string, wherein the replenishment string comprises the first constituent and/or the second constituent;

wherein the elevating device, after a heat generating process is started by means of the ignition device, is configured to control the movement of the replenishment string towards the heat generating process;

wherein the well tool system comprises a setting tool provided between the replenishment string and the well tool device, wherein the setting tool is configured to disconnect the replenishment string from the well tool device;

wherein the well tool device comprises an anchoring device for anchoring of the well tool device to the well; and wherein the setting tool is configured to radially expand the anchoring device of the well tool device before disconnecting the replenishment string from the well tool device.

2. The system according to claim 1, wherein the replenishment string is a longitudinal extension of the tool string.

3. The system according to claim 1, wherein the first constituent comprises bismuth oxide (Bi2O3) and the second constituent comprises aluminum (Al).

4. The system according to claim 1, wherein the elevating device is located topside.

5. The system according to claim 4, wherein the elevating device is a top drive or rotary table when the tool string is a drill pipe type of string, a reel drive or injector when the tool string is a coiled tubing type of string or a reel drive when the tool string is a wireline type of string.

6. The system according to claim 1, wherein the tool string is a drill pipe type of string, a coiled tubing type of string, or a wireline type of string.

7. The system according to claim 1, wherein the replenishment string comprises one or a plurality of sensors for sensing the heat distribution along the replenishment string; and wherein the elevating device, is configured to control the movement of the replenishment string towards the heat generating process based on signals from the one or the plurality of sensors.

8. The system according to claim 7, wherein the one or a plurality of sensors is an optic fiber sensor guided in the longitudinal direction of the replenishment string.

9. The system according to claim 1, wherein the replenishment string comprises one or more further ignition devices provided within or adjacent to the pyrotechnic mixture.

10. The system according to claim 1, wherein the pyrotechnic mixture provided in a lower end of the replenishment string has a first set of properties; wherein the pyrotechnic mixture provided in an upper end of the replenishment string has a second set of properties being different from the first set of properties; and wherein the elevating device, is configured to control the movement of the replenishment string towards the heat generating process based on the first set and the second set of properties.

11. The system according to claim 1, wherein the replenishment string comprises an elongated housing and a compartment within the elongated housing, wherein the compartment contains the first constituent and/or the second constituent.

12. The system according to claim 11, wherein the elongated housing is made of the first constituent and/or the second constituent.

13. A method for forming a permanent barrier in a well, wherein the method comprises the steps of:

providing a well tool device comprising a pyrotechnic mixture and an ignition device provided within or adjacent to the pyrotechnic mixture, wherein the pyrotechnic mixture comprises a first constituent in the form of a metal oxide and a second constituent in the form of a metal;

connecting a tool string above the well tool device;

connecting a replenishment string between the well tool device and the tool string, wherein the replenishment string comprises the first constituent and/or the second constituent;

starting a heat generating process by means of the ignition device;

controlling, by means of an elevating device, the movement of the replenishment string towards the heat generating process; and providing a setting tool provided between the replenishment string and the well tool device, wherein the setting tool is configured to disconnect the replenishment string from the well tool device;

wherein the well tool device comprises an anchoring device for anchoring of the well tool device to the well; and wherein the setting tool is configured to radially expand the anchoring device of the well tool device before disconnecting the replenishment string from the well tool device.

* * * * *